US011376631B2

(12) United States Patent
Kykyri et al.

(10) Patent No.: US 11,376,631 B2
(45) Date of Patent: Jul. 5, 2022

(54) MOBILE SCREEN BODY AND MOBILE MINERAL MATERIAL PROCESSING PLANT WITH SUPPORT LEGS

(71) Applicant: Metso Minerals, Inc., Tampere (FI)

(72) Inventors: Tommi Kykyri, Tampere (FI); Lasse Salo, Tampere (FI)

(73) Assignee: Metso Minerals, Inc., Tampere (FI)

( * ) Notice: Subject to any disclaimer, the term of this patent is extended or adjusted under 35 U.S.C. 154(b) by 0 days.

(21) Appl. No.: 17/053,219

(22) PCT Filed: May 6, 2019

(86) PCT No.: PCT/FI2019/050349

§ 371 (c)(1),
(2) Date: Nov. 5, 2020

(87) PCT Pub. No.: WO2019/215387

PCT Pub. Date: Nov. 14, 2019

(65) Prior Publication Data

US 2021/0069751 A1 Mar. 11, 2021

(30) Foreign Application Priority Data

May 8, 2018 (FI) ..... 20180063

(51) Int. Cl.
*B07B 1/00* (2006.01)

(52) U.S. Cl.
CPC ..... *B07B 1/005* (2013.01)

(58) Field of Classification Search
CPC .. B07B 1/005; B07B 1/28; B07B 1/46; B07B 2201/02
See application file for complete search history.

(56) References Cited

U.S. PATENT DOCUMENTS 5,362,193 A * 11/1994 Milstead ..... B65D 88/30 414/332
7,461,746 B1 12/2008 Egge et al.
(Continued)

FOREIGN PATENT DOCUMENTS

CN 201807443 U 4/2011
CN 202343287 U 7/2012
(Continued)

OTHER PUBLICATIONS

Acceptance Office Action for Finnish Patent Application No. 20180063 dated Nov. 16, 2018.
(Continued)

*Primary Examiner* — Joseph C Rodriguez
(74) *Attorney, Agent, or Firm* — Andrus Intellectual Property Law, LLP

(57) ABSTRACT

A mobile screen body and a mobile mineral material processing plant are disclosed that include a platform frame, a plurality of legs for supporting the platform frame to ground, a screen support frame supported by the platform frame movably between a transport position in which the screen support frame is adjacent to the platform frame and an operating position in which the screen support frame is elevated from the transport position, and a plurality of supports having first ends configured to be structurally coupled with the screen support frame, and second ends configured to be structurally coupled with respective ones of the plurality of legs, when the screen support frame is in the operating position. The supports are arranged in pairs that reside outside the platform frame in sideways direction.

18 Claims, 3 Drawing Sheets

(56) References Cited

U.S. PATENT DOCUMENTS

| | | | | |
|---|---|---|---|---|
| 8,162,245 | B2 * | 4/2012 | Sauser | B07B 1/005 241/76 |
| 8,505,738 | B2 * | 8/2013 | O'Keeffe | B07B 1/46 209/421 |
| 8,783,443 | B2 * | 7/2014 | Erkkila | B65G 41/007 198/506 |
| 8,820,536 | B2 * | 9/2014 | Schirm | B07B 1/46 209/420 |
| 9,409,184 | B1 * | 8/2016 | Mickelson | B03B 9/00 |
| 11,033,933 | B2 * | 6/2021 | Rafferty | B07B 1/005 |
| 2001/0020656 | A1 | 9/2001 | Frick | |
| 2003/0146315 | A1 | 8/2003 | Boast | |
| 2013/0037450 | A1 * | 2/2013 | Schirm | B07B 1/28 209/233 |

FOREIGN PATENT DOCUMENTS

| | | | |
|---|---|---|---|
| CN | 205289126 | U | 6/2016 |
| CN | 206229629 | U | 6/2017 |
| CN | 106944646 | A | 7/2017 |
| DE | 3119946 | A1 | 12/1982 |
| DE | 19600897 | C1 | 4/1997 |
| DE | 202017104017 | U1 | 7/2017 |
| EP | 3061511 | A1 | 8/2016 |
| GB | 2072532 | A | 10/1981 |
| WO | 2015033013 | A1 | 3/2015 |

OTHER PUBLICATIONS

International Search Report and Written Opinion for International Patent Application No. PCT/FI2019/050349 dated Sep. 11, 2019.
International Preliminary Report on Patentability for International Patent Application No. PCT/FI2019/050349 dated May 28, 2020.
Search Report for corresponding Chilean Patent Application No. 2877-2020 dated Sep. 8, 2021.
Office Action and Search Report for corresponding Chinese Patent Application No. 201980030284.X dated Feb. 18, 2022.

* cited by examiner

Fig. 2
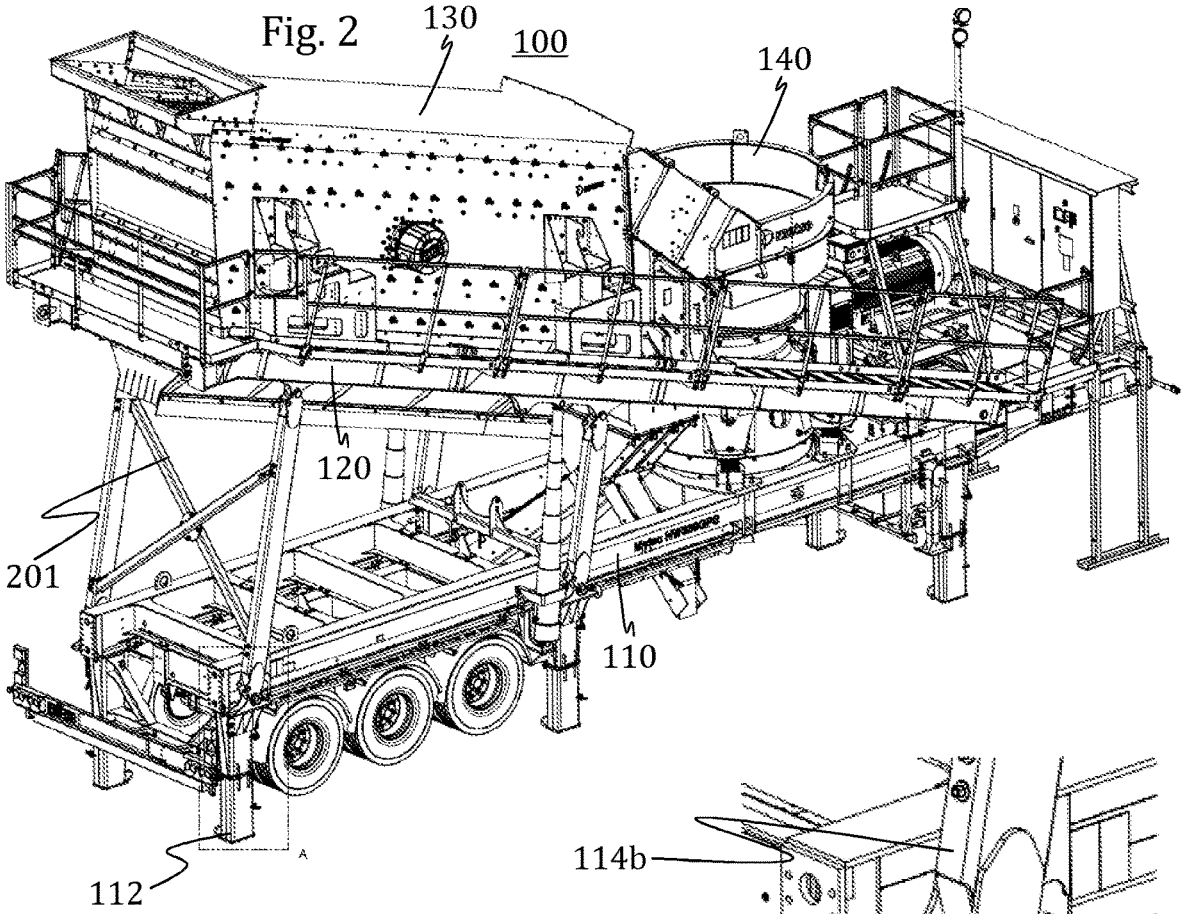
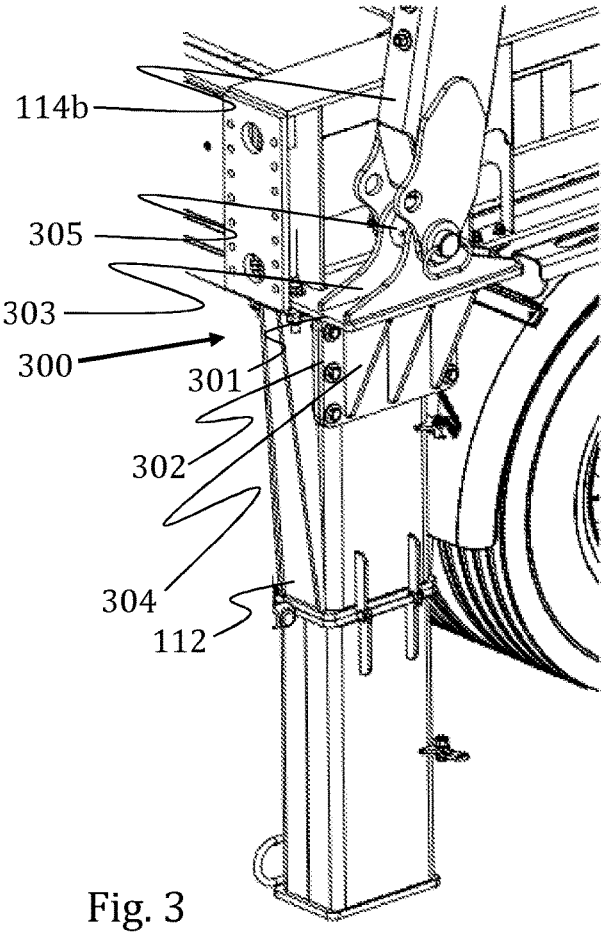
Fig. 3

MOBILE SCREEN BODY AND MOBILE MINERAL MATERIAL PROCESSING PLANT WITH SUPPORT LEGS

CROSS-REFERENCE TO RELATED APPLICATIONS

This application is the U.S. national stage application of International Application PCT/FI2019/050349, filed May 6, 2019, which international application was published on Nov. 14, 2019, as International Publication WO 2019/215387 A1 in the English language. The International Application claims priority of Finnish Patent Application No. 20180063 filed May 8, 2018.

TECHNICAL FIELD

The present invention generally relates to a mobile screen and a mobile mineral material processing plant with support legs.

BACKGROUND ART

This section illustrates useful background information without admission of any technique described herein representative of the state of the art.

A mobile screen for mineral material can be implemented as a trailer to be towed by a truck. To this end, the mobile screen can be pivotably moved between an operating position and transport position in which the screen is compacted in order to meet transport dimensions.

The screen can be motorized to shake mineral material down along and through the screen so as to separate fractions of different dimensions. One or more screen decks can be vibrated through a screen frame to which screen meshes are attached. The screen frame itself can be vibrated by a vibrator, such as a motor that rotates an eccentric mass. When resiliently supported e.g. by springs, the screen moves under vibration effect back and forth so that mineral material covering the screen passes through or along the screen towards the front end of the screen for subsequent in-line crushing or conveying for further processing or use.

A mobile screen is typically implemented with a two-tier frame system comprising a platform chassis and a screen support frame that carries the screen, a crusher (if provided) and any conveyors. The processing equipment frame is pivoted to the platform frame and moved between the operating and transport positions by hydraulic rams. In order to support the screen more robustly, the platform frame is supported by legs against ground and supports maintain the screen support frame in its correct position above the platform frame e.g. by beams fixed between the platform and screen support equipment frames.

Impacts and vibration experienced by the screen support frame are conveyed to the platform frame which thus needs to be very robustly built accordingly. This further increases the total mass of the mobile screen, which may be problematic particularly in terms of transport (mass limits of bridges, fuel consumption).

It is an object of the present invention to provide reduce weight and/or increase robustness of a mobile screen.

SUMMARY

According to a first aspect, there is provided a mobile screen body comprising:

a platform frame;

a plurality of legs for supporting the platform frame to ground;

a screen support frame supported by the platform frame movably between a transport position in which the screen support frame is adjacent to the platform frame and an operating position in which the screen support frame is elevated from the transport position; and a plurality of supports having first ends configured to be structurally coupled with the screen support frame and second ends configured to be structurally coupled with respective ones of the plurality of legs, when the screen support frame is in the operating position.

The supports may be arranged in pairs that reside outside the platform frame in sideways direction.

Structural coupling may be arranged by coupling parts with each other directly or via one or more intermediate parts such that the coupled parts are structurally connected together.

The mobile screen body may further comprise lifting equipment for moving the screen support frame between the transport position and the operating position. The lifting equipment may comprise at least one hydraulic ram. The at least one hydraulic ram may be telescopic.

The second ends of the legs may be configured to be structurally coupled with respective ones of the plurality of legs, when the screen support frame is in the operating position, so that downward forces experienced by the screen support frame are transmitted to the legs bypassing the platform frame. Downward forces of each support may be directed to respective legs via the second ends of the supports.

The first ends of the supports may be pivotably coupled with the screen support frame. The second ends of the supports may be detachably attachable to respective legs in the operating position. The screen support frame may comprise stowing points configured to enable detachably attaching of the second ends of the supports to the stowing points in the transport position.

In the operating position, the screen support frame may be pivoted to an upwards inclining angle of greater than 10 degrees. In the operating position, the screen support frame may be pivoted to an upwards inclining angle of less than 20 degrees.

The supports may be beams. The first ends of the supports may be shaped as forks configured to extent around plate formed structures of the screen support frame. The second ends of the supports may be shaped as forks configured to extent around plate formed structures of the legs.

The plurality of legs may reside under the platform frame. The plurality of legs may be attached to the platform frame.

The supports may be arranged in two pairs so that the legs of each pair reside at same distance from the pivot joint.

The mobile screen body may further comprise one or more X-beam structures for strengthening at least one of the pairs of the supports when the screen support frame is in the operating position. The X-beams may be configured to increase sideways sturdiness of the screen support frame.

The supports may be inclined towards pivot connection between the platform frame and the screen support frame so as robustly support the screen support frame against the pivot joint.

The legs may be extendable. The legs may be hydraulically extendable. The legs may be foldable. The platform frame may comprise wheel suspension for a plurality of wheels. The wheel suspension may be retractable and expandable by machine operation for transferring weight of the mobile screen body from the wheels to the legs and back to the wheels so that the legs can be set up for operating position and for the transport position without equipping the legs with actuators.

The platform frame may be made of steel plate.

The plurality of legs may be made of steel plate.

The screen support frame may be made of steel plate.

The plurality of supports may be made of steel plate.

According to a second aspect, there is provided a mobile mineral material processing plant comprising:

the screen body of the first aspect; and a screen attached to the screen support frame.

The screen may be attached to the screen support frame via a plurality of spring groups each comprising one or more springs. The first ends of the supports may be configured to be detachably attachable to the screen support frame under a respective spring group.

The mobile mineral material processing plant may further comprise a crusher attached to the platform frame. The crusher may be a cone crusher. The crusher may be an impact crusher. The crusher may be a jaw crusher. The mobile mineral material processing plant may further comprise a feed for supplying an oversize fraction of the screen to the crusher.

The mobile mineral processing plant may be constructed to be transportable as a semi-trailer.

According to a third aspect, there is provided a method in a mobile screen body, comprising:

supporting by a plurality of legs a platform frame to ground;

supporting the platform frame a screen support frame movably between a transport position in which the screen support frame is adjacent to the platform frame and an operating position in which the screen support frame is elevated from the transport position; and structurally coupling first ends of a plurality of supports with the screen support frame and second ends of the supports with respective ones of the plurality of legs, when the screen support frame is in the operating position.

Different non-binding example aspects and embodiments of the present invention have been illustrated in the foregoing. The embodiments in the foregoing are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

Some example embodiments of the invention will be described with reference to the accompanying drawings, in which:

FIG. 2 shows a perspective view of the mobile mineral material processing plant of FIG. 1;

FIG. 3 shows a detail of a leg and a support joint of FIG. 2; and

DETAILED DESCRIPTION

In the following description, like reference signs denote like elements or steps.

Figure 1:
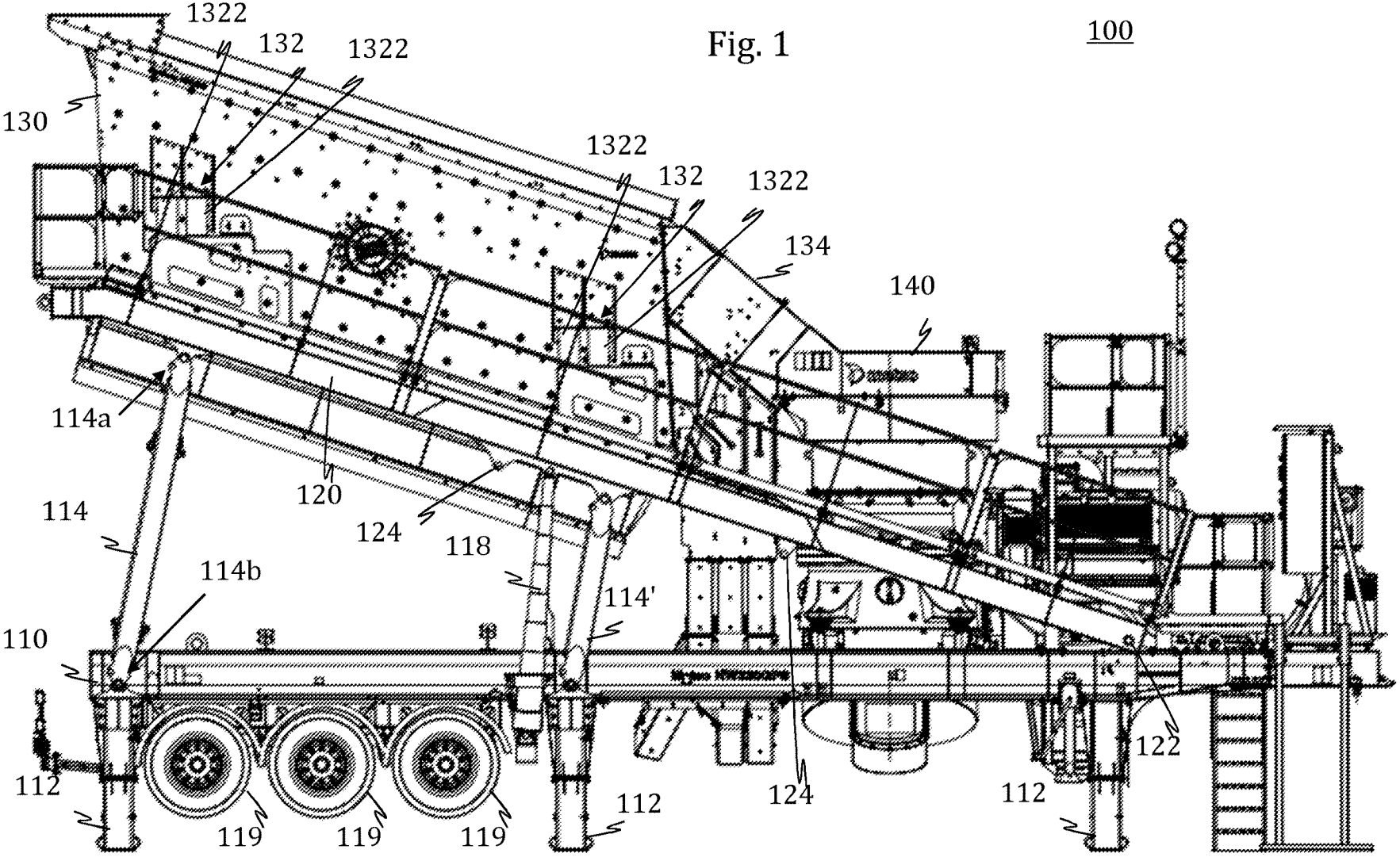
FIG. 1 shows a side view of a mobile mineral material processing plant according to an embodiment of the invention in an operating position.

FIG. 1 shows a side view of a mobile drawing of a mobile mineral material processing plant 100 according to an embodiment of the invention. The plant comprises a mobile screen body that comprises a platform frame 110;

a plurality of legs 112 for supporting the platform frame 110 to ground (e.g., for sturdy supporting of the mobile screen body when operating any equipment attached to the mobile screen body, such as a screen and/or crusher);

a screen support frame 120 supported by the platform frame 110 movably (e.g., pivotably over a pivot joint 122) between a transport position (not shown) in which the screen support frame 120 is adjacent to the platform frame and an operating position (shown in FIG. 1) in which the screen support frame 120 is elevated from the transport position (e.g., pivoted to an upwards inclining angle); and a plurality of supports 114, 114' having first ends **114*a* configured to be structurally coupled with the screen support frame 120 and second ends 114*b* configured to be structurally coupled with respective ones of the plurality of legs 112, when the screen support frame 120** is in the operating position.

The supports 114, 114' can be arranged in pairs that reside outside the platform frame 110 in sideways direction (perpendicularly to the longitudinal direction i.e. the direction of the platform frame 110).

The supports 114, 114' drawn in FIG. 1 differ only by length. However, as their structure is not quite identical, the shorter ones are depicted with reference sign 114'. In some embodiments, there are yet also other differences (for example, in the thickness, form of the first and/or second ends, materials and/or profile)

In an embodiment, lifting equipment is provided for moving the screen support frame 120 between the transport position and the operating position. The lifting equipment comprise, for example, at least one hydraulic ram 118. The at least one hydraulic ram can be telescopic such that the ram can achieve sufficient extension length while not extending obtrusively low in the transport position.

The first ends **114*a* of the supports 114, 114' are shown to be pivotably coupled with the screen support frame. The second ends 114*b* of the supports 114, 114' are in this embodiment detachably attachable to respective legs 112 in the operating position. The screen support frame of FIG. 1 comprises for ease of transport stowing points 124 configured to enable detachably attaching of the second ends 114*b* of the supports 114 to the stowing points 124** in the transport position.

The upwards inclining angle of the screen support frame 120 can be, for example, greater than 10 degrees and/or less than 20 degrees.

The supports 114, 114' can be beams. The first ends **114*a* of the supports 114, 114' are shaped in an embodiment as forks configured to extent around plate formed structures of the screen support frame 120. The second ends 114*b* of the supports 114, 114' can be shaped as forks configured to extent around plate formed structures of the legs 112. The forks can be integrally formed into the supports or attached, for example, by bolts or welding. The counterpart structures in the screen support frame 120 and/or the legs 112** can be also integrally formed or provided with separate parts.

The supports 114, 114' can be arranged in two pairs so that the legs (112) of each pair reside at same distance from the pivot joint (122). In some embodiments, at least one of the pairs of the supports can be strengthened by use of one or more X-beam structures. The structure is preferably removable.

The supports 114, 114' can be inclined towards pivot joint 122 so as to robustly support the screen support frame 120 against the pivot joint 122. This may be particularly useful in that if there is some play in the pivot joint, the screen support frame forms a force that in both positions and throughout moving between the operating and transport positions keeps the pivot joint 122 in the same extreme of the play.

In FIG. 1, the screen support frame 120 is shown movably supported by the platform frame 110 using a pivot joint. In an alternative embodiment, the screen support frame 120 movably supported by the platform frame 110 using, for example, hydraulic or pneumatic rams, linear motors, and/or wedges.

The legs 112 can be made extendable, e.g. hydraulically or by manual action. As an example of manual extending, the legs 112 can be foldable. In order to enable easy use of such manually extendable legs 112, the platform frame 110 can be equipped with wheel suspension for a plurality of wheels 119 that is retractable and expandable by machine operation for transferring weight of the mobile screen body from the wheels 119 to the legs 112 and back to the wheels 119 so that the legs 112 can be set up for operating position and for the transport position without necessarily equipping the legs 112 with actuators such as hydraulic or pneumatic cylinders or electric actuators. The platform frame 110 can be alternatively equipped with crawler tracks. In an embodiment, the platform frame 110 also comprises a crawler track suspension for one or more crawler tracks, which crawler track suspension is retractable and expandable by machine operation. The platform frame 110 can be equipped with an engine unit to provide self-propelling capability.

Various parts of the structures can be made of steel plate, including, for example, partially or entirely any one or more of the following: platform frame 110; the legs 112; the screen support frame 120; and the supports 114, 114'.

In FIG. 1, the mobile mineral material processing plant 100 further comprises a screen 130 attached to the screen support frame 120.

The screen 130 can be attached to the screen support frame 120 via a plurality of spring groups 132 each comprising one or more springs 1322. The first ends 114*a* of the supports 114, 114' can be configured to be detachably attachable to the screen support frame 120 under a respective spring group 132.

In an embodiment, the mobile mineral material processing plant 100 further comprises a crusher 140 attached to the platform frame 110, such as a cone crusher, an impact crusher or a jaw crusher. The mobile mineral material processing plant 100 further comprises in an embodiment a feed 134 such as a channel or conveyor for supplying an oversize fraction of the screen 130 or screening produced by the screen 130 to the crusher 140.

The mobile mineral processing plant 100 is constructed in an embodiment to be transportable as a semi-trailer.

FIG. 3 shows a detail of a leg and a support joint of FIG. 2 for structurally coupling the support 114 of FIG. 1 with the leg 112. The support joint 300 comprises a horizontal connecting part 301 that is connected to a top part of the leg 112. On the upper side of the connecting part 301 a hinge bracket 303 is connected on the connecting part 301. The hinge bracket preferably comprises two vertical parts at a distance of each other both having an aperture for receiving a locking pin 305 that connects the second end 114*b* of the support via the support joint 300 to the leg 112.

The support joint 300 further comprises a vertical connecting part 302 below the horizontal connecting part 301, which vertical connecting part is connected to the upper side of the support leg 112.

The support joint 300 further comprises vertical brackets 304 that are connected to the vertical connecting part 302 and to the horizontal connecting part 301.

Parts 301-304 are preferably connected together by welding.

In an embodiment, the support joint further structurally couples the leg 112 with the platform frame 110. For example, the platform frame 110 can be constructed using two side beams that are I-beams. An outer surface of the leg 112 and the vertical connecting part 302 can be aligned with an outer edge of a flange of a side beam of the platform frame 110 and the horizontal connecting part 301 can sandwich the outer side of the flange. The horizontal connecting part 302 can be bolted to the leg 112 through the outer side of the flange of the platform frame 110. The inner side of the flange can be bolted to the leg 112 as well so that the leg 112 is firmly attached to the platform frame 110 on both sides of the web of the side beam.

By structurally coupling the support 114 to the leg 112 sandwiching a portion of the flange of the side beam of the platform frame 110, vertical forces can be directed through the support 114 to the leg 112 without stressing seams of the side beams. Also incurring shear forces to the platform frame 110 may be avoided.

Figure 4:
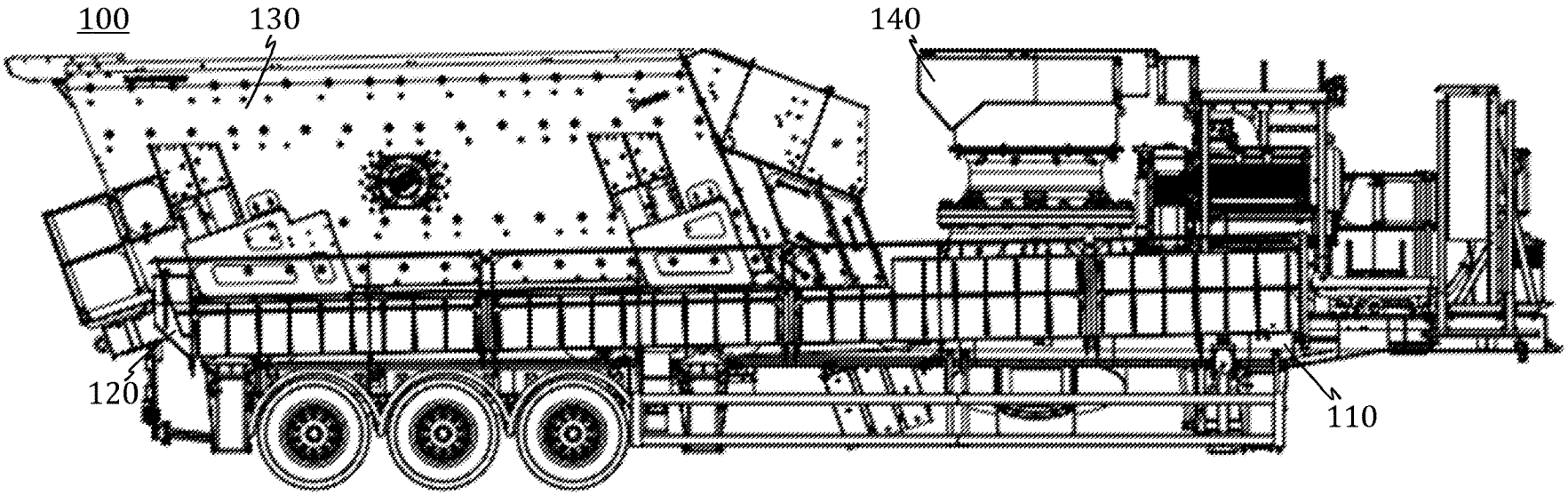
FIG. 4 shows a side view of a mobile mineral material processing plant according to an embodiment of the invention in a transport position.

FIG. 4 shows a side view of a mobile mineral material processing plant according to an embodiment of the invention in a transport position.

Various embodiments have been presented. It should be appreciated that in this document, words comprise, include and contain are each used as open-ended expressions with no intended exclusivity.

The screen in question can be also a horizontal screen, wherein the supports 114 and 114' are equal length. The screen support frame can be also without the pivot point 122.

Springs can be metal or rubber springs or torsion bar type elastic members as an example.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented in the foregoing, but that it can be implemented in other embodiments using equivalent means or in different combinations of embodiments without deviating from the characteristics of the invention.

Furthermore, some of the features of the afore-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. A mobile screen body that comprises a platform frame;

a plurality of legs for supporting the platform frame to ground;

a screen support frame supported by the platform frame movably between a transport position in which the screen support frame is adjacent to the platform frame and an operating position in which the screen support frame is elevated from the transport position; and a plurality of supports having first ends configured to be structurally coupled with the screen support frame and second ends;

which supports are arranged in pairs that reside outside the platform frame in sideways direction; wherein:

the second ends are configured to be structurally coupled with respective ones of the plurality of legs, when the screen support frame is in the operating position; and the mobile screen body further comprises a plurality of support joints for structurally coupling the supports with the respective one of the legs, each of the support joints comprising a horizontal connecting part that is connected to a top part of the legs.

2. The mobile screen body of claim 1, wherein the second ends of the supports are detachably attachable to respective legs in the operating position.

3. The mobile screen body of claim 1, wherein the plurality of legs reside under the platform frame.

4. The mobile screen body of claim 1, wherein the mobile screen body further comprises lifting equipment for moving the screen support frame between the transport position and the operating position.

5. The mobile screen body of claim 4, wherein the first ends of the supports are pivotably coupled with the screen support frame with a pivot joint.

6. The mobile screen body of claim 5, wherein the supports are arranged in two pairs so that the legs of each pair reside at same distance from the pivot joint.

7. The mobile screen body of claim 1, wherein the mobile screen body further comprises one or more X-beam structures for strengthening at least one of the pairs of the supports when the screen support frame is in the operating position.

8. The mobile screen body of claim 1, wherein the legs are extendable.

9. The mobile screen body of claim 1, wherein the platform frame comprises a wheel suspension for a plurality of wheels, which wheel suspension is retractable and expandable by machine operation.

10. The mobile screen body of claim 1, wherein the platform frame comprises a crawler track suspension for one or more crawler tracks, which crawler track suspension is retractable and expandable by machine operation.

11. A mobile mineral material processing plant, wherein the mobile mineral material processing plant comprises the mobile screen body of claim 1.

12. The mobile mineral material processing plant of claim 11, wherein the mobile mineral material processing plant further comprises a screen attached to the screen support frame.

13. The mobile mineral material processing plant of claim 11, wherein the screen is attached to the screen support frame via a plurality of spring groups each comprising one or more springs and the first ends of the supports are configured to be detachably attachable to the screen support frame under a respective spring group.

14. The mobile mineral material processing plant of claim 11, wherein the mobile mineral material processing plant further comprises a crusher attached to the platform frame.

15. The mobile mineral material processing plant of claim 11, wherein the mobile mineral processing plant is transportable as a semi-trailer.

16. The mobile screen body of claim 1, wherein the support joint comprises a hinge bracket configured to hingedly couple the supports to the horizontal connecting part.

17. The mobile screen body of claim 1, wherein the support joint structurally couples the legs to the platform frame.

18. The mobile screen body of claim 1, wherein the support joint further comprises a vertical connecting part connected to the leg below the horizontal connecting part.

* * * * *